US005251578A

United States Patent [19]

Kawauchi et al.

[11] Patent Number: 5,251,578

[45] Date of Patent: Oct. 12, 1993

[54] COOLING SYSTEM FOR INTERNAL COMBUSTION ENGINE

[75] Inventors: Masato Kawauchi, Mishima; Kiyoshi Nakanishi; Masayoshi Tokoro, both of Susono; Shizuo Abe, Mishima, all of Japan

[73] Assignee: Toyota Jidosha Kabushiki Kaisha, Aichi, Japan

[21] Appl. No.: 888,653

[22] Filed: May 27, 1992

[30] Foreign Application Priority Data

Jun. 4, 1991 [JP] Japan ..... 3-133051
Aug. 27, 1991 [JP] Japan ..... 3-215510

[51] Int. Cl.[5] ..... F02F 1/10
[52] U.S. Cl. ..... 123/41.84; 123/41.79
[58] Field of Search ..... 123/41.74, 41.83, 41.84, 123/41.79

[56] References Cited

U.S. PATENT DOCUMENTS 1,575,638 3/1926 Pochobradsky et al. ..... 123/41.84
4,759,317 7/1988 Ampferer ..... 123/41.84

FOREIGN PATENT DOCUMENTS 168242 11/1988 Japan .
3-51701 3/1991 Japan .

*Primary Examiner*—Noah P. Kamen
*Attorney, Agent, or Firm*—Oliff & Berridge

[57] ABSTRACT

A cooling system for an internal combustion engine able to realize a cooling effect matching a distribution of incoming heat of a cylinder liner. A plurality of annular grooves are formed on an outer surface of the cylinder liner, and a passage connecting the annular grooves is also provided. An introducing passage part is formed between an inlet passage of a coolant and the uppermost annular groove. A curved portion is provided to the introducing passage part. A flow direction of the coolant flowing into the introducing passage part is smoothly changed so as to flow along a direction of a passage connecting the annular grooves. An amount of coolant flowing into the annular grooves located lower than the uppermost annular groove is increased appropriately.

7 Claims, 7 Drawing Sheets

COOLING SYSTEM FOR INTERNAL COMBUSTION ENGINE

BACKGROUND OF THE INVENTION (1) Field of the Invention

The present invention relates to a cooling system for an internal combustion engine, and more particularly to a cooling system which cools an internal combustion engine by flowing a coolant inside annular grooves provided to an outer surface of a cylinder.

(2) Description of the Related Art.

Conventionally, there is disclosed a cooling system of a cylinder liner, for example in Japanese Laid-Open Utility Model Application No.63-168242. The cooling system disclosed in this Application includes a plurality of grooves for cooling formed on and along an outer surface of a cylinder liner in a direction roughly perpendicular to an axis of the cylinder liner. The system also includes two connecting grooves connecting these grooves and extending in the direction of the axis of the cylinder liner. The later grooves are positioned in 180 degree opposition from each other along a diameter of the cylinder liner. Continuing passages for coolant are formed between each of the grooves on the outer surface of the cylinder liner and the inner surface of a bore of a cylinder block by fitting the cylinder liner to the bore of the cylinder block.

In Japanese Patent Application No.3-51701, the applicant suggested a system as shown in FIG. 1 as a cooling system for an internal combustion engine as mentioned above, a so called groove cooling.

In FIG. 1, a plurality of square cross-sectioned annular grooves 3 are formed on an outer surface of a cylinder liner 2. The annular grooves 3 are equally spaced along a direction of the axis of the cylinder liner 2 which is fitted to a cylinder block 1. These annular grooves 3 form annular passages for a coolant between an outer surface of the cylinder liner 2 and an inner surface 4 of a bore of the cylinder block 1, when the cylinder liner 2 is fitted to the bore of the cylinder block 1.

Longitudinal grooves 5*a*, 5*b* and 6*a*, 6*b* connecting the grooves 3 are formed extending in a direction of an axis of the cylinder liner 2 in positions where the cylinder liner 2 and the cylinder block 1 face each other. In the cylinder block 1, inlet ports 7*a*, 7*b*, which are respectively connected to the longitudinal grooves 5*a*, 5*b*, and outlet ports 8*a*, 8*b*, which are respectively connected to the longitudinal grooves 6*a*, 6*b*, are formed.

A pump 9 for delivering a coolant delivers a coolant to two separate lines. Coolant going to one line is highly pressurized and supplied to the inlet port 7*a* via a filter 10. Coolant going to the other line is low pressure, and is supplied to the inlet port 7*b* directly. The coolant supplied to the inlet port 7*a* flows through the longitudinal groove 6*a* and outflows from the outlet port 8*a*, after flowing through the longitudinal groove 5*a* and being delivered to the annular grooves 3 in the upper part of the cylinder and flowing through the grooves 3. The coolant supplied to the inlet port 7*b* flows through the longitudinal groove 6*b* and outflows from the outlet port 8*b*, after flowing through the longitudinal groove 5*b* and being delivered to the annular grooves 3 in the lower part of the cylinder and flowing through the grooves 3. The coolant outflowing from the outlet ports 8*a*, 8*b* are joined together and are returned to the pump 9 via a radiator, not shown.

According to the system mentioned above, heat generated in a combustion chamber and transferred from a cylinder head to the cylinder liner 2 can be eliminated by cooling a wall of the cylinder liner 2. The wall of the cylinder liner 2 has an incoming heat distribution such that the incoming heat at the uppermost part of the cylinder liner 2, as in FIG. 1, is highest and degrades as it goes to the lower part. Therefore, it is required that the amount of coolant flow in the annular groove 3 closest to a combustion chamber is maximized and the flow decreases as it flows the groove 3 further apart from the uppermost groove 3, as indicated by c in FIG. 2, so as to uniformly cool down the wall of the cylinder liner 2.

In the system mentioned above, if a diameter of the longitudinal grooves 5*a*, 5*b*, 6*a*, 6*b* is larger than the predetermined size, a distribution of the coolant flow in the plurality of the grooves 3 is constant, as indicated by a in FIG. 2. However, by decreasing the diameter of the longitudinal grooves 5*a*, 5*b*, 6*a*, 6*b*, the coolant flow in the grooves 3 in the upper part can be relatively larger than that in other grooves 3, and thus the distribution of the coolant flow can be similar to the distribution of the incoming heat on the wall of the cylinder liner 2 indicated by c in FIG. 2.

However, in the system mentioned above, since the difference of the flow between the uppermost groove 3 and a lower groove 3 is too large, it is difficult to match the distribution of the flow to the distribution of the incoming heat. The cause of this problem is that the amount of the coolant flowing into the uppermost groove 3 is much larger than that flowing into the lower groves 3 because that the uppermost groove is located in a direction of the coolant flow and, on the contrary, the grooves 3 lower than the uppermost groove 3 are located perpendicular to the direction of the coolant flow, thus generating a pressure loss due to the bend in the direction of the flow. As a result, in the system mentioned above, the main part of the coolant flows in a direction as indicated by an arrow in FIG. 1.

SUMMARY OF THE INVENTION

It is a general object of the present invention to provide an improved cooling system for an internal combustion engine in which the above-mentioned disadvantages are eliminated.

A more specific object of the present invention is to provide a cooling system in which a distribution of a cooling effect matches a distribution of incoming heat of a cylinder liner by improving a delivery amount of coolant to each of a plurality of coolant passages.

The above-mentioned objects of the present invention are achieved by a cooling system comprising:

a supply source of a coolant cooling a cylinder liner;

a plurality of annular grooves, spaced apart from each other in an axial direction of said cylinder liner, formed along a circumference of an outer surface of the cylinder liner;

longitudinal grooves connecting the plurality of annular grooves for inflow and outflow of a coolant, the longitudinal grooves extending along a direction of the axis of the cylinder liner, and being provided in opposite sides of a diameter of the cylinder liner; and an introducing part formed so as to smoothly introduce the coolant from the supply source to a longitudinal direction of the longitudinal groove for inflow of a coolant.

According to the present invention, a coolant flows smoothly into the longitudinal groove for inflow of a coolant because a coolant introducing part is formed such that a direction of the flow of the coolant can bend smoothly, with less pressure loss, to the longitudinal direction of the longitudinal groove for inflow of the coolant. Thus, a sufficient amount of coolant can flow into annular grooves other than the uppermost groove, which is closest to a combustion chamber.

Therefore, a distribution of the flow of the coolant can be matched to the distribution of the incoming heat of the cylinder liner, and thus the wall of the cylinder liner can be cooled uniformly.

Other objects, features and advantages of the present invention will become more apparent from the following detailed description when read in conjunction with the accompanying drawings.

DESCRIPTION OF THE PREFERRED EMBODIMENTS

Figure 1:
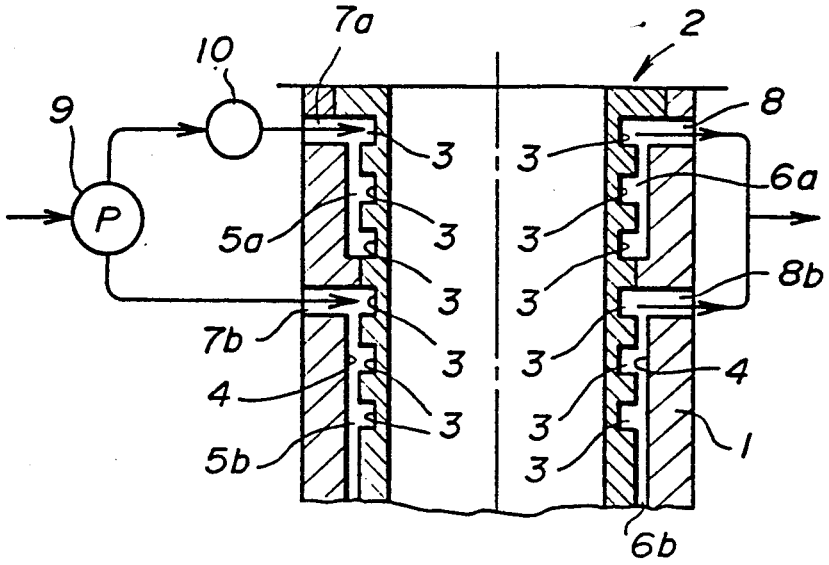
FIG. 1 (RELATED ART)
FIG. 1 is a cross sectional view of an example of a conventional cooling system.
Figure 2:
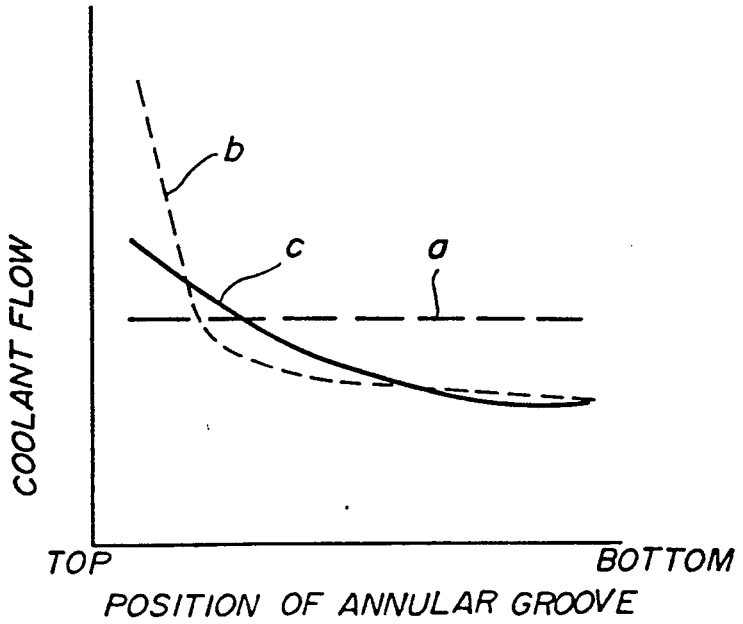
FIG. 2 is a graphical representation showing a distribution of incoming heat of a cylinder liner and a distribution of a coolant flow corresponding to the diameter of the longitudinal groove.
Figure 3A:
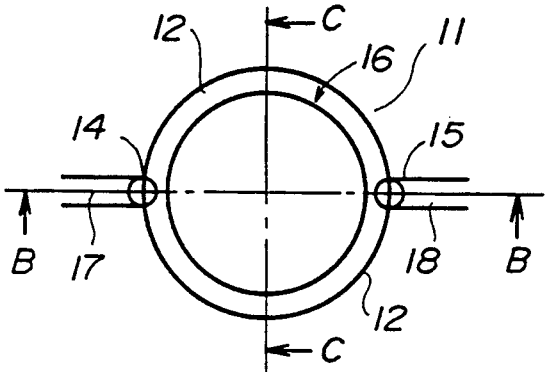
FIGS. 3A, 3B and 3C are schematic illustrations of a first embodiment of the present invention, FIG. 3A showing a plane view, FIG. 3B showing a cross sectional view taken along the line B—B of FIG. 3A, and FIG. 3C showing a cross sectional view taken along the line C—C of FIG. 3A.
Figure 3B:
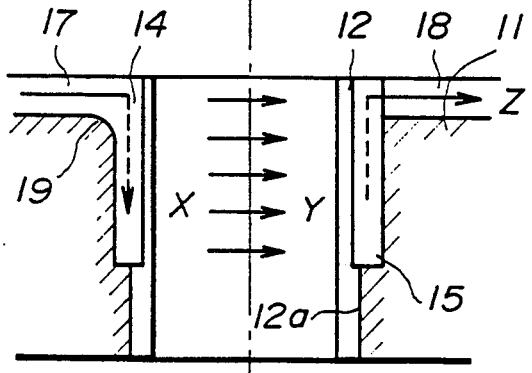
Figure 3C:
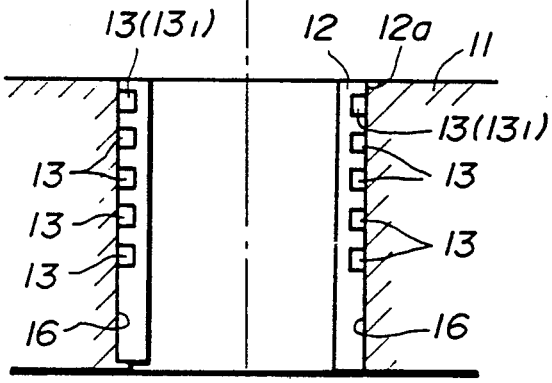

Referring to FIGS. 3A, 3B, and 3C showing a first embodiment of the present invention, a plurality of annular grooves 13 circumferentially formed on an outer surface 12*a* of a cylinder liner 12 are spaced apart from each other in a direction of the axis of the cylinder liner 12. The annular grooves 13 and an inner surface 16 of a bore of the cylinder block 11 jointly form annular passages for a coolant. Longitudinal grooves 14 and 15 are formed on an inner surface of the cylinder block 11, and on the outer surface of the cylinder liner 12. Both grooves 14, 15 extend in the direction of the axis of the cylinder liner 12, and are across from each other along a direction of the diameter of the cylinder liner 12. The plurality of annular grooves 13 are connected to each other by the grooves 14, 15. The groove 14 serves as an inflow passage of a coolant and the groove 15 serves as an outflow passage of the coolant.

an inlet passage 17 is connected to the groove 14 and an outlet passage 18 is connected to the groove 15. The conjunction of the inlet passage 17 and the groove 14 functions as an introducing passage part for an inflowing coolant to the annular grooves 13. Annular grooves $\mathbf{13}_1$, one of the annular grooves 13 located on the uppermost portion of the cylinder liner 12, is the groove closest to a combustion chamber.

In this embodiment, the introducing passage part, which is a conjunction of the inlet passage 17 and the groove 14, includes an arc shaped curve indicated by numeral reference 19 of FIG. 3B. In the conventional cooling system, the portion corresponding to the curve 19 is a right angle.

Flow of the coolant in this embodiment is explained below. A coolant, delivered from a pump (not shown), flows into the inlet passage 17, The coolant flows into the groove 14 via the introducing part and then enters into each of the plurality of annular grooves 13. After the coolant enters into the annular grooves 13, the coolant flows along the grooves 13, as is indicated by an arrow Y in FIG. 3, then the coolant in each groove 13 enters into the longitudinal groove 15. The coolant from the grooves 13 flows together in the groove 15 and, as indicated by an arrow Z in FIG. 3B, the joined coolant flows out via the outlet passage 18.

The coolant passed through the inlet passage 17 enters into the groove $\mathbf{13}_1$, which is closest to a combustion chamber, and also a portion of the coolant flows into the longitudinal groove 14 with less pressure loss than in conventional technology due to the curve 19 formed in the introducing passage part. This results in an increased amount of coolant flow to the grooves 13 located lower than the uppermost groove $\mathbf{13}_1$. Accordingly, by this embodiment of the present invention, a distribution of the flow of the coolant can be matched to the distribution of the incoming heat of the cylinder liner, and thus the wall of the cylinder liner can be cooled uniformly.

Figure 4:
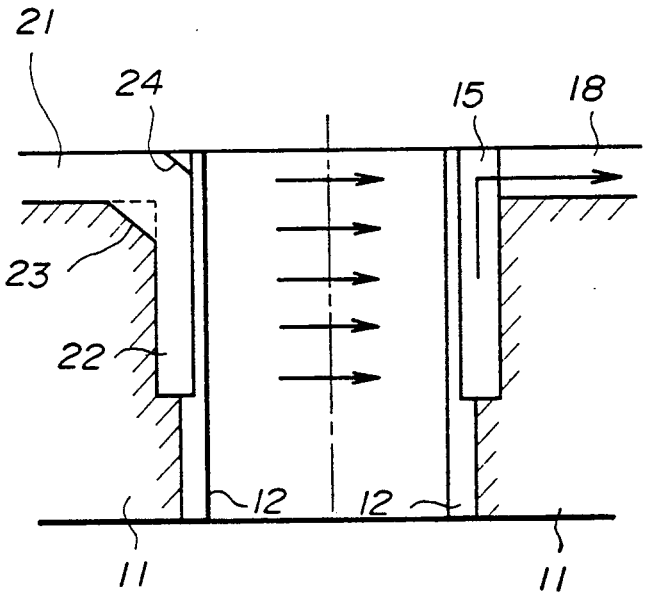
FIG. 4 is a cross sectional view of a second embodiment of the present invention.

FIG. 4 is a cross sectional view of a second embodiment of the present invention. In FIG. 4, those parts that are the same as corresponding parts in FIG. 3A, 3b and 3C are designated by the same reference numerals, and descriptions thereof will be omitted. A construction of the second embodiment of the present invention is the same as in the first embodiment mentioned above except for a difference in an introducing passage part for the coolant, which part is a conjunction of an inlet passage 21 and a longitudinal groove 22.

The introducing passage part of this embodiment includes a slant 23 instead of the curve 19 of the first embodiment and also includes another slant 24 on a side of the passage opposite to the slant 23. Due to these slants 23 and 24, a direction of the coolant is bent with less pressure loss, and the distribution of the coolant flow can be optimized as in the first embodiment.

Figure 5A:
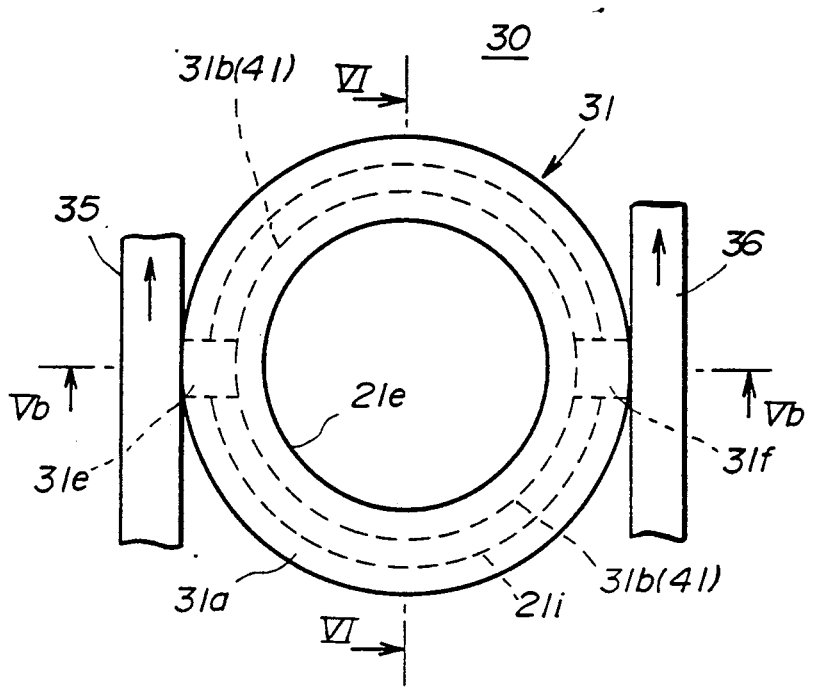
FIGS. 5A and 5B are respectively a plane view of a third embodiment of the present invention and a cross sectional view taken along the line Vb—Vb of FIG. 5A.
Figure 5B:
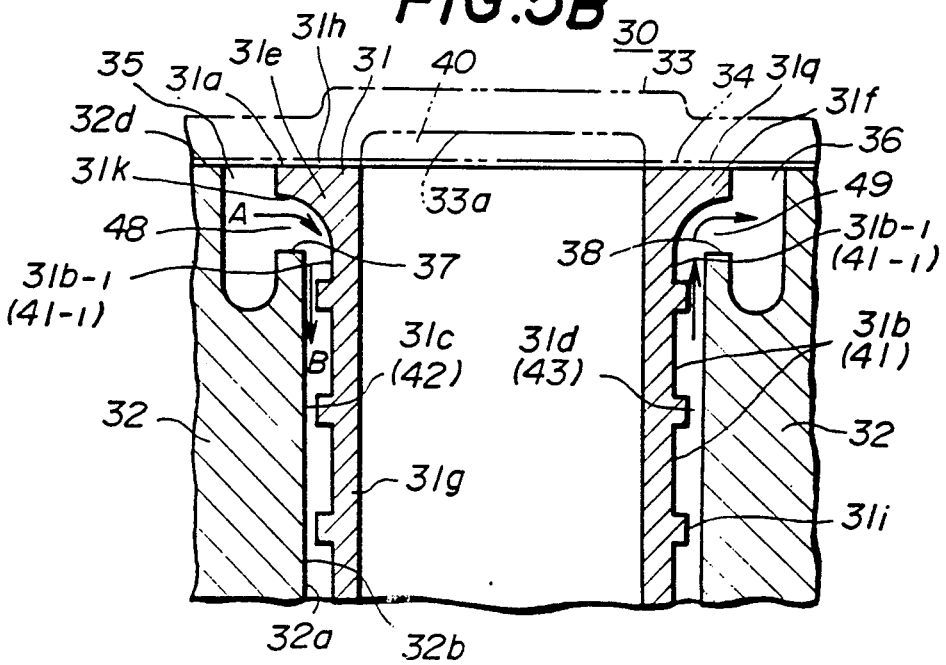
Figure 6:
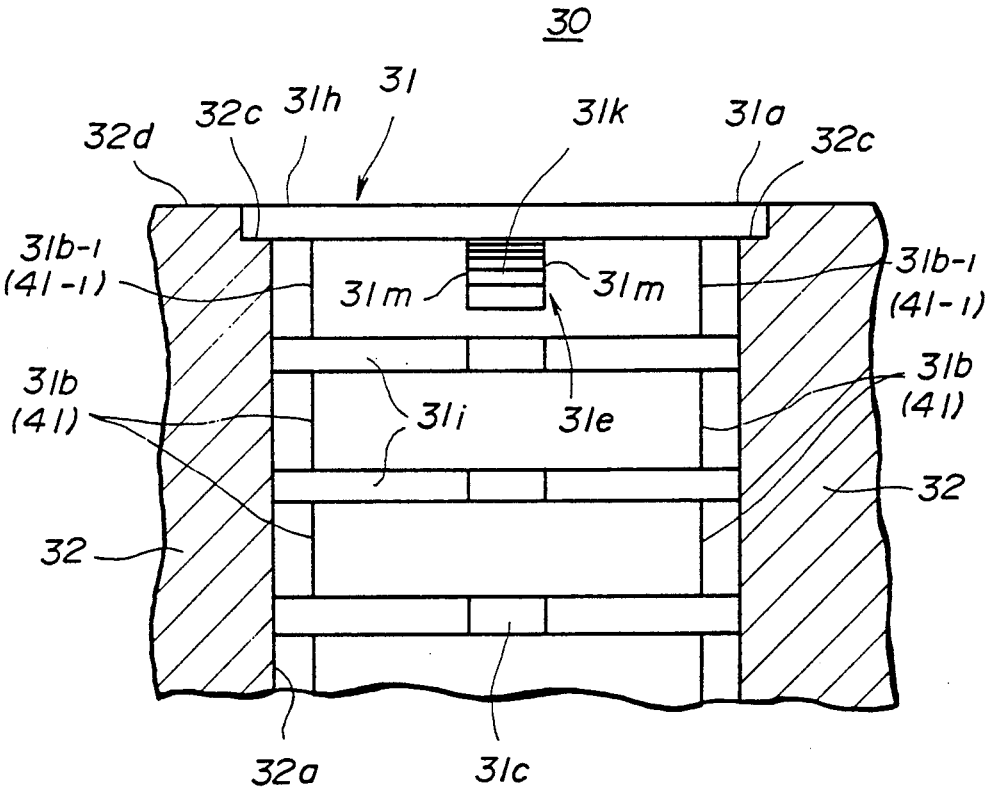
FIG. 6 is a cross sectional view taken along the line VI—VI of FIG. 5B.

FIGS. 5A and 5B are respectively a plane view of a third embodiment of the present invention and a cross sectional view taken along the line Vb—Vb of FIG. 5A. FIG. 6 is a cross sectional view taken along the line VI—VI of FIG. 5B. In FIG. 6, a cylinder liner 31 is shown in a side view for conveniency of description. In FIG. 5B, numeral reference 31 is a cylinder liner, 32 a cylinder block, 33 a cylinder head and 34 a head gasket. The cylinder liner 31 is fitted in a bore 32*a* of the cylinder block 32. The cylinder head 34 is fixed to the cylinder block 32 with the gasket 34 in between.

An inner surface 31*g* of the cylinder liner 31, which inner surface is a sliding surface of a piston ring of a piston (not shown), is machined smooth. A combustion chamber 40 is formed between a bottom surface 33*a* of the cylinder head and a top surface of a piston at the lowermost position.

The cylinder liner 31, being made of casting iron, is formed in cylindrical shape, and a flane 31*a* is formed at the uppermost end of the cylinder liner 31.

A plurality of annular grooves 31*b* formed on an outer surface of the cylinder liner 31 for coolant passage, are spaced apart from each other in a direction of the axis of the cylinder liner 31. Longitudinal grooves 31*c* and 31*d* are formed along a direction of the axis of the cylinder liner 31 in positions across from each other along a direction of a diameter of the cylinder liner 31. These longitudinal grooves 31*c* and 31*d* connect the annular grooves 31*b*.

Curves 31*e* and 31*f* are formed respectively at portions of a bottom surface of the flange 31*a* at upper extensions of the longitudinal grooves 31*c* and 31*d*. Each of the curves 31*e* and 31*f* has an arc shaped surface which smoothly connects the bottom surface of the flange 31*a* and a bottom surface of the uppermost annular groove $31b_1$. The width of each of the curve 31*e* and 31*f* is the same size as the width of the grooves 31*c* and 31*d* respectively.

A bore 32*a*, in which the cylinder liner 31 is fitted, is formed on the cylinder block 32. Passages 35 and 36 respectively are connecting passages for inlet and outlet of the coolant for a plurality of cylinders. The passages 35 and 36 are provided along a direction of an arrangement of the plurality of cylinders. Upper sides of the the passages 35 and 36 are closed by the gasket 34 when the cylinder head is fixed on the cylinder block 32; thus the enclosed passages 35 and 36 are formed. An inlet passage 37 is formed between the passage 35 and the bore 32*a*, and an outlet passage 38 is formed between the passage 36 and the bore 32*a*. The inlet passage 37 serves as an introduction passage part for the coolant flowing into the groove 31*c*.

As shown in FIGS. 5A and 5B, the cylinder liner 31 is fitted in the bore 32*a* of the cylinder block 32 such that the curves 31*e* and 31*f* are respectively provided to the inlet passage 37 and the outlet passage 38. As shown in FIG. 6, a flange supporting member 32*c* is formed around the bore 32*a* at the upper portion of the cylinder block 32 excepting the positions where the inlet and outlet passages 37 and 38 are located. The bottom surface of the flange 31*a*, being supported on the member 32*c*, allows the cylinder liner 31 to be held inside the bore 32*a* of the cylinder block 32. In this state, a top surface 32*d* of the cylinder block 32 and a top surface of the flange 31*a* are in the same plane.

In the state where the cylinder liner 31 is fitted in the bore 32*a*, as shown in FIG. 5B, the inlet passage 37 and the curve 31*e* jointly form an introducing part 48, and the Outlet passage 38 and the curve 31*f* jointly form a discharging part 49. Separations 31*i* formed between two adjacent annular grooves 31*b* have the same diameter as the bore 32*a* excepting positions where the longitudinal grooves 31*c* and 31*d* are formed. Thus each of the grooves 31*b* forms a coolant passage 41 jointly with the inner surface of the bore 32*a*. The uppermost passage $41_1$ is the closest passage to the introducing part 48 and the discharging part 49. The longitudinal grooves 31*c* and 31*d* are formed by machining the separations in a direction of the axis of the cylinder liner 31 so that the grooves 31*c* and 31*d* form respectively a connecting passage 42 and 43 jointly with the inner surface of the bore 32*a*.

When the engine is in operation, the coolant flows into the passage 42 from the passage 35 via the introducing passage part 48, and then the coolant flows from the upper part to the lower part and is delivered to each of a plurality of the coolant passages 41. After the coolant has absorbed heat from the cylinder liner 31 while flowing each passage 41, the coolant flows together again in the passage 43 and is then discharged to the passage 36 via the discharging passage part 49.

Since the introducing passage part comprises the inlet passage 37 of the cylinder block 32 and a curved surface 31*k* of the curve 31*e*, the direction of flow of the coolant is guided by the surface 31*k* and is changed, as indicated by an arrow A in FIG. 5B, from the direction along the diameter to the direction along the axis of the cylinder liner 31. In other words, the surface 31*k* of the cylinder liner 31 serves as a guiding member, to have the direction of the flow changed to the direction along the passage 42. Accordingly, a portion of coolant from the introducing passage part 48 flows into he passage $41_1$ and the remaining coolant is guided by the surface 31*k* to enter into the passage 42 so as to be delivered to each of the coolant passages 41.

As mentioned above, in the cooling system 30 of this embodiment, the amount of coolant that flows to the uppermost passage $41_1$ is reduced, and the amount of coolant that flows to lower passages is increased compared to flows in the conventional system. As a result, in the cooling system 30, a distribution of a cooling effect on the cylinder liner can be such that the cooling effect on the upper portion of the cylinder is appropriately high and cooling effect is reduced appropriately in the lower portions. Therefore, distribution of the flow of the coolant can be matched to the distribution of the incoming heat of the cylinder liner, and thus the wall of the cylinder liner can be cooled uniformly.

Additionally, in the cooling system 30, the curves 31*e* and 31*f* function as reinforcing members to give a rigidity to the flange 31*a* of the cylinder liner 31. In the state where the engine is assembled, the cylinder head 33 is firmly fixed to the cylinder block 32 with the gasket 34 in between so as to withstand a high pressure generated in the combustion chamber 40 and maintain a good seal. The flange 31*a* of the cylinder liner 31 is also pressed strongly by the cylinder head 33 via the gasket 34. The flange 31*a* is not supported by the cylinder block 32 portions where the inlet and outlet passages 37 and 38 are formed. This previously resulted in a partial deformation of the flange 31*a* which led to a lack of pressing force of the gasket 34.

However, the cylinder liner 31 of this embodiment has the protruding curves 31*e* and 31*f* on the bottom surface of the flange 31*a* at a portion corresponding to the position where the inlet and outlet passages are located. These curves function like a rib to increase the rigidity of the flange 31*a* at these locations. Accordingly, the partial deformation of the flange 31*a* is prevented and the gasket 34 can give a good seal for a combustion gas and a coolant around the flange 31*a*.

Figure 7:
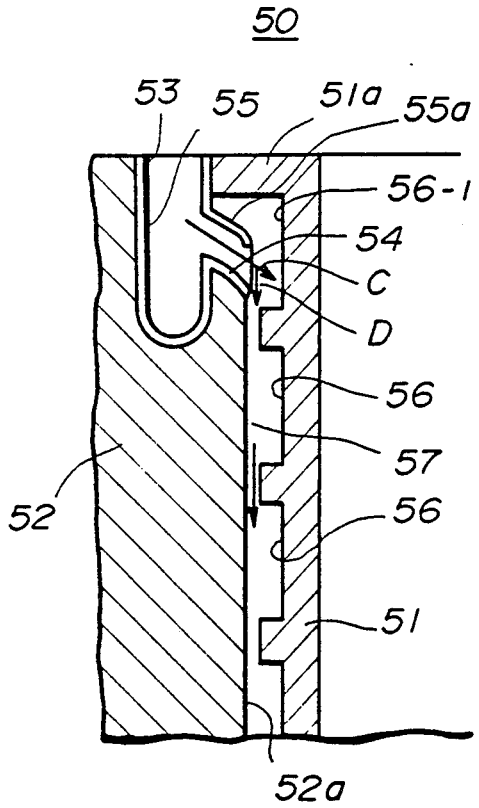
FIG. 7 is a partial cross sectional view of a fourth embodiment of the present invention.

FIG. 7 is a partial cross sectional view of a fourth embodiment of the present invention. A cylinder liner 51 has the same construction as the cylinder liner 31 shown in FIG. 5B except that the cylinder liner 51 does not have curves on the bottom surface of a flange 51*a*. In a cylinder block 52, there is formed a bore 52*a*, a passage 53, and an inlet passage 54 for a coolant. The passage 53 is for delivering the coolant to each cylinder of an engine. The cooling system 50 of this embodiment is provided with a spacer 55 formed as a separate part in the portions of the passage 53 and the inlet passage 54. The spacer 55 has a guide pipe 55*a* which guides the coolant from the passage 53 in a slanted direction to a passage 57 corresponding to the passage 42 in FIG. 5B.

In the cooling system 50, a portion of the coolant from the guide pipe 55*a* flows into the uppermost passage $56_1$, as indicated by an arrow C, and the remaining coolant is guided by the guide pipe 51*a* to enter into the passage 57, as indicated by an arrow D, so as to be delivered to each of the coolant passages 56. As a result, in the cooling system 50, like in the above mentioned cooling system 30, a distribution of a cooling effect of the cylinder liner can be such that the cooling for the upper portion is appropriately high and the cooling degrades towards the lower portions of the cylinder. Therefore, a distribution of the flow of the coolant can be matched to the distribution of the incoming heat of the cylinder liner, and thus the wall of the cylinder liner can be cooled uniformly.

Figure 8:
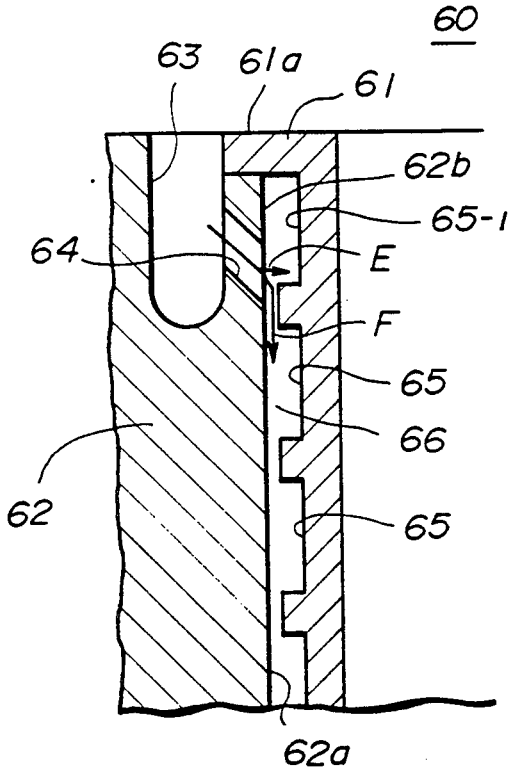
FIG. 8 is a partial cross sectional view of a fifth embodiment of the present invention.

FIG. 8 is a partial cross sectional view of a fifth embodiment of the present invention. A cylinder liner 61 has the same construction as the cylinder liner 51 of the fourth embodiment shown in FIG. 7. In a cylinder block 62, is formed a bore 62*a* and a passage 63 for delivering a coolant to each cylinder. A wall 62*b* is formed around the bore 62*a* in an upper portion of the cylinder block 62. An inlet passage 64, which is a slanted through hole, is formed on the wall 62*b*. The inlet passage connects the passage 63 and the passage 66 corresponding to the passage 42 of the third embodiment shown in FIG. 5B.

In the cooling system 60, a portion of the coolant from the inlet passage 64 flows into the uppermost passage $65_1$, as indicated by an arrow E, and the remaining coolant is guided by the inlet passage 64 to enter into the passage 66, as indicated by an arrow F, so as to be delivered to each of the coolant passages 65. As a result, in the cooling system 60, like in the above mentioned cooling system 50, a distribution of a cooling effect on the cylinder liner can be such that the cooling for the upper portion is appropriately high and the cooling degrades towards the lower portions. Therefore, a distribution of the flow of the coolant can be matched to the distribution of the incoming heat of the cylinder liner, and thus the wall of the cylinder liner can be cooled uniformly.

Additionally, in the cooling system 60, a flange 61*a* of the cylinder liner 61 is entirely supported on the wall 62*b*. Therefore, the partial deformation of the flange 61*a*, described in the description of the third embodiment, is prevented and the gasket (not shown) can give a good seal for a combustion gas and a coolant around the flange 61*a*.

The present invention is not limited to the specifically disclosed embodiments, and variations and modifications may be made without departing from the scope of the present invention.

What is claimed is:

1. A cooling system for an internal combustion engine comprising:

a supply source of a coolant for cooling a cylinder liner;

a plurality of annular grooves, spaced apart from each other in an axial direction of said cylinder liner, formed along a circumference of an outer surface of said cylinder liner, a cross section of all of said plurality of annular grooves being the same and uniform;

longitudinal grooves, for inflow and outflow of a coolant, each of said longitudinal grooves connecting all of said plurality of annular grooves by extending in a direction of an axis of said cylinder liner, and provided at opposite sides of a diameter of said cylinder liner, the coolant being supplied to one end of one of said longitudinal grooves for inflow of a coolant from a direction perpendicular to the extending direction of said longitudinal grooves; and an introducing passage part formed so as to smoothly introduce the coolant from said supply source to the extending direction of said longitudinal groove for inflow of a coolant.

2. The cooling system as claimed in claim 1, wherein said introducing passage part includes an arc shaped curved portion having a smooth curvature so as to continuously change a direction of a flow of the coolant flowing into one of said annular grooves from a radial direction of said cylinder liner to flow along a longitudinal direction of said longitudinal groove for inflow of a coolant.

3. The cooling system as claimed in claim 2, wherein said curved portion is provided on said cylinder liner side.

4. The cooling system as claimed in claim 1, wherein said introducing passage part includes at least one slanting surface.

5. The cooling system as claimed in claim 1, wherein said introducing passage part comprises a slanted tubular portion which is provided such that the coolant flows along the direction of the slanted tubular portion into one of said annular grooves.

6. The cooling system as claimed in claim 5, wherein said tubular portion comprises a guiding pipe provided in said cylinder block.

7. The cooling system as claimed in claim 5, wherein said tubular portion comprises a through hole formed on a wall located between a coolant passage connecting a plurality of cylinders and an inner surface of said cylinder block to which said cylinder liner is fitted.

* * * * *